United States Patent [19]

Pauliukonis

[11] 4,321,021

[45] Mar. 23, 1982

[54] METERING PUMP

[76] Inventor: Richard S. Pauliukonis, 6660 Greenbriar Dr., Cleveland, Ohio 44130

[21] Appl. No.: 47,779

[22] Filed: Jun. 11, 1979

Related U.S. Application Data

[62] Division of Ser. No. 637,647, Dec. 4, 1975, Pat. No. 4,189,285.

[51] Int. Cl.[3] ..... F04B 9/14; F04B 17/04

[52] U.S. Cl. ..... 417/374; 417/417; 222/340

[58] Field of Search ..... 417/417, 416, 415, 392, 417/403, 505, 402, 401, 374, 425, 497, 374; 222/340

[56] References Cited

U.S. PATENT DOCUMENTS

| | | | |
|---|---|---|---|
| 1,174,674 | 3/1916 | Byer | 222/340 |
| 2,382,426 | 8/1945 | Kocher | 417/374 |
| 2,829,631 | 4/1958 | Wilt | 417/417 |
| 3,072,300 | 1/1963 | Thomas | 417/374 |
| 3,286,637 | 11/1966 | Malec | 417/497 |
| 3,492,946 | 2/1970 | Martin | 417/401 |
| 3,676,022 | 8/1972 | Pauliukonis | 417/392 |
| 3,877,841 | 4/1975 | Nakamura | 417/568 |
| 3,939,755 | 2/1976 | Tabor | 91/235 |
| 4,076,465 | 2/1978 | Pauliukonis | 92/13.3 |
| 4,189,285 | 2/1980 | Pauliukonis | 417/403 |

*Primary Examiner*—William L. Freeh

*Attorney, Agent, or Firm*—Richard S. Pauliukonis

[57] ABSTRACT

A solenoid operated metering pump for displacement of exact amounts of fluid pumped by reciprocation of pumping piston incorporating integral check valve has an elongated valve housing with solenoid operator serving as pump actuating means attached to one housing end while the other housing end is adaptable to serve as the fluid pumping means including an appropriate housing bore passing therethrough and adaptable to receive a differential diameter piston assembly slidably movable therein to reciprocate when solenoid operator becomes electrically cycled inducing fluid flow through appropriate pump chamber created therein between piston and housing bore portion provided with fluid supply port having a detachable check valve with a simple floater for a directional flow control therethrough, means of piston actuation from a first position checking flow and discharge of the fluid delivered to the pump chamber to a second position discharging exact fluid quantity per each stroke of pump reciprocation, and means of metering such fluid flow, including appropriate piston and housing bore seals separating pumping chamber from actuating chamber, as well as provisions for manual override.

10 Claims, 2 Drawing Figures

METERING PUMP

This is a division of application Ser. No. 637,647, filed Dec. 4, 1975 now U.S. Pat. No. 4,189,285.

This invention relates to metering pumps of simplified design for handling various fluids from liquids to gases in relatively small quantities per stroke but capable of delivering large fluid volume when number of strokes multiplied, such stroke increase conveniently controlled by solenoid operator which is adaptable to either valved pilot use for pump operation or to directly actuate pump piston for a subsequent piston reciprocation and pumping of fluid at specific controlled pump capacity per stroke, thereby enabling simple means to positively move fluid from a source to a receiver without the use of motors representing state of the art in pumps of present design.

It has been difficult if not impossible to pump exact fluid quantities in metered amounts with equipment for pumping in existance simply because there is no pump design on the market capable of such function unless resorted to very complicated controls which mostly are in fact not only unneeded but in majority of cases are too costly. Therefore, the object of this invention is to provide simple means for pumping fluids in metered amounts by the use of commonly available solenoid operators comprising generally a ferritic plunger passing within electrically developed magnetic field of a copper coil of multiple turns surrounding such plunger and together with appropriate plunger spring allowing to move a pump piston axially within a pump housing for pumping through piston reciprocation therein.

Further object of the present invention is to overcome many of the above-mentioned deficiencies of the prior art lacking on simple solenoid, pilot or manual pump.

These and other objects and advantages of the invention will become more fully apparent from the following description and accompanying drawings.

IN THE DRAWINGS

Figure 1:
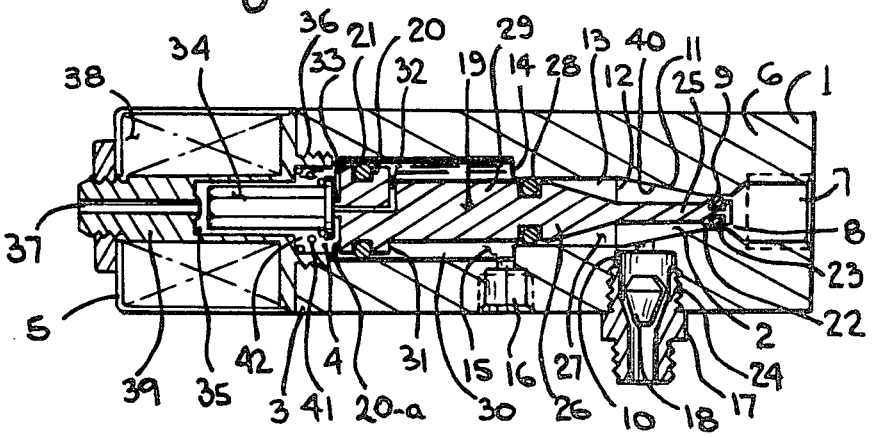
FIG. 1 is a cross-section of a metering pump with integral check valve operated by a pilot solenoid, including a check valve in the fluid supply port, detachably mounted inside a housing side port.

As can be seen from FIG. 1, the metering pump consists of the following basic parts:

an elongated pump housing 1 with a central differential diameter bore 2 passing therethrough for slidably receiving appropriate piston therein, having an integral check valve seat 8 adjacent one housing ends, including at last two side ports;

an elongated piston assembly 19 with body of different diameters corresponding to the diameters of the differential diameter bore 2 for a sliding fit therein with a first large piston end having a head 20 with a seal 21 and comprising a pump actuating means at the first housing end, and with a second piston assembly end 22 with seal 23 which is small, inside the check valve seat 8 comprising integral check valve 9 adjacent the second housing end, including a detachable check valve 17 having a floater sealing member 18 therein in one of said side ports;

and an electrically energized solenoid operator 5 disposed at the first housing end so as to cause piston reciprocation with pumping when solenoid becomes electrically energized thereby creating appropriate magnetic field inside operator cavity 35 to selectively move a solenoid plunger 34 axially, disposed therein in an operating relationship with the piston assembly 19.

Pump housing 1 includes a first housing end 3 provided with a large opening 4 adaptable to be closed by the solenoid operator 5, and a second housing end 6 provided with a fluid discharge port 7 inside of which a small aperture 8 ideally serves as a seat for a slidably moving seal 23 of the integral check valve 9. A conical seat 40 of tapered bore portion 11 adjacent aperture 8 continues inwardly with small end started at aperture 8 while the other inward end of the cone terminates with base 12 comprising in fact a diameter of the adjacent inwardly passing cylindrical bore portion 13 which continues toward the first housing end 3 enlarging again at shoulder 14 to a larger bore portion 15 which ends at opening 4 shown to be threaded for securing the solenoid operator 5 therein.

A first side port 10 enters conical seat 40 of bore portion 11 to supply fluid for pumping at metered amounts when piston is reciprocated inside housing bore 2, and is hence provided with the detachable check valve 17 for a directional control of the fluid flow into and through the pump, secured permanently therein by way of mating threads 24. A second side port 16 permits a pilot fluid to enter valve housing bore portion 15 adjacent shoulder 14 for aiding pump operation in conjunction with the solenoid operator 5.

Piston assembly 19 including the first large diameter piston head 20 with seal 21 of sliding fit with bore portion 15 incorporates therein an end face **20-*a* facing plunger 34 inside cavity 35, and an undercut 31 opposite end face 20-*a*, adjacent seal 21. It further continues as an elongated piston portion 29 of the diameter slightly smaller than the diameter of the cylindrical bore portion 13 with a seal 28 of a close sliding fit therewith, adjacent shoulder 14, inside bore portion 13 to subsequently taper down on an angle identical to the angle of the tapered bore portion 11 as shown by 26 to a straight necked-down piston section 25 of length equivalent to the pump stroke, having a diameter substantially smaller than the aperture 8 to facilitate an unabstrated fluid passage through an annulus created therein when piston assembly is moved from the position shown in FIG. 1 to have tapered piston portion 26 engage the conical seat 40 of bore portion 11 so as to displace all fluid from a pump cavity 27 clearly visible in FIG. 1 when solenoid operator 5 becomes energized, and the pilot pressure entering annular space 30 created between bore portion 15 and piston portion 29 that maintains piston assembly 19 in the first position of FIG. 1 while acting over undercut 31, is allowed to enter solenoid cavity 35 by way of a pilot port 32 starting adjacent undercut 31 and exiting in the center of head protrusion 33 normally covered by plunger 34 until the solenoid operator becomes energized uncovering pilot port 32 to exhaust pressurized pilot fluid into cavity 35 for subsequent action over the end face 20-*a* and piston position change from that shown in FIG. 1 to the second pump actuated position wherein mating surfaces of piston taper 26 and of conical seat 40 of bore portion 11 meet in direct contact, in fact thereby reducing seat loading distributed over the entire surface of mating tapers and extending service life of such pumps. It is not to say that tapers 26 and 40** could not be made square and act as shoulders meeting each other to displace fluid from such pump if applicational requirements allow this, without departing from the scope and the spirit of this invention.

The solenoid operator 5 entering bore opening 4 at the first housing end 3 is permanently secured therein by way of externally threaded boss 36 with a counterbore 42 facing piston head 20 to accomodate solenoid plunger 34 held against piston protrusion 33 by a spring 41 in axial relationship so as to normally close central pilot port 32 when the position of pump assembly components is as shown in FIG. 1, identifying solenoid cavity 35 open to atmosphere by way of solenoid exhaust port 37 shown therein. When solenoid coil 38 becomes energized electrically, iron 39 becomes magnetic capable of pulling plunger 34 away from the piston head 20 to close atmospheric solenoid exhaust port 37 rendering cavity 35 under pressure which, as discussed before, acts over piston head 20 initiating piston reciprocation and pumping. When solenoid energization is however discontinued, the magnetic force disappears and the plunger returns back into the original position over the protrusion 33 as a result of the force of the compression spring 41, discontinuing supply of the pilot pressure via pilot port 32, thereby allowing instant pressure rise in annular space 30 to act over piston undercut 31 with a force large enough to return piston assembly back into original position shown in FIG. 1 for pump filling with new supply of fluid to be pumped, via check valve 17 with unabstrated flow passage therethrough. Only when piston assembly 19 is reciprocatingly moved to discharge fluid from pump cavity 27, the check valve 17 becomes automatically closed by the fluid pressure action over floater 18 while the check valve 9 opens for fluid discharge via port 7.

This solenoid-pilot operated pump of FIG. 1 provides most simple means for metering fluids pumped by the use of a pressurized pilot fluid entering annular space 30 via side port 16 to maintain piston head 20 against solenoid boss 36 and the seal 23 inside seat of aperture 8. Seals 23 and 28 spaced a distance apart insure that pump cavity 27 receives fluid supply via port 10 through check valve 17 until the solenoid becomes energized lifting plunger 34 and thereby uncovering piston port 32 to discharge pilot fluid into the solenoid cavity 35 acting, in effect with a mechanical advantage, over the piston end face 20-*a* with a force larger than the opposing undercut 31-force to shift piston assembly 19 from the position of FIG. 1 into pumping and thereby fluid displacement from pump cavity 27 via discharge port 7 until the tapered piston portion 26 is forced into its mating conical seat 40 for a complete fluid displacement therefrom while the check valve 17 closes to insure fluid metering for as long as the cycle repeats. The instant the solenoid operator is deenergized allowing solenoid cavity 35 to exhaust via port 37, the pressure force over the end face 20-*h* disappears when the plunger 34 covers up pilot port 32 stopping further supply of pilot fluid into the solenoid cavity 35, and the piston assembly 19 becomes automatically shifted back by undercut 31 force into the original position with pump cavity 27 ready to draw a new fluid supply to be discharged therefrom again in exact metered amount when the cycle repeats, or during piston reciprocation when the solenoid operator 5 gets cycled.

Figure 2:
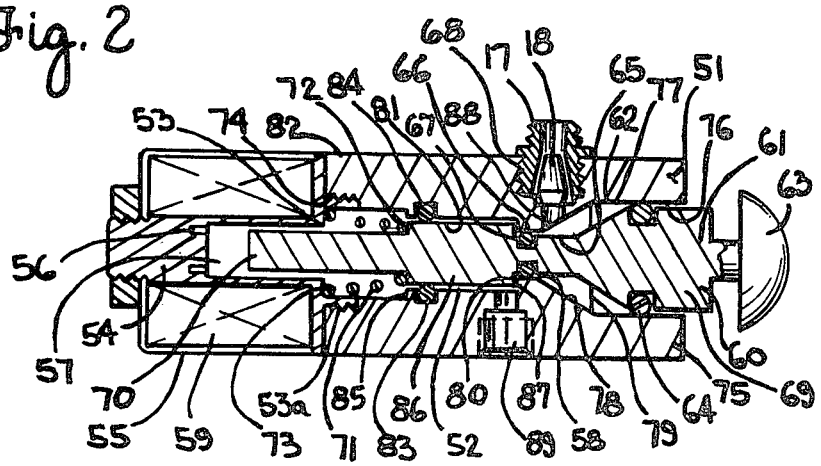
FIG. 2 is a cross section of a metering pump with integral check valve operated directly by the solenoid plunger, including external check valve in fluid supply port as well as a manual override provision, opposite the solenoid operator.

The pump shown in FIG. 2 in all respect is analogous to the pump shown in FIG. 1 except that there is no pilot fluid to help in the operation of the pump, with a mechanical advantage at that. But, it was established that many applications of various processes, in particular those packaged independently, can not get compressed air nor other pressurized fluid and therefore require other solution for pumping fluids in metered quantities, often in minute capacities and at rather low pressures. To cover a gap of such vital but non-existing pumps, the pump described while discussing design of FIG. 1 was modified and presented in design shown in FIG. 2.

As can be seen from FIG. 2, the metering pump directly operated by a solenoid operator consists of essentialy the same basic parts as the pump of FIG. 1, which are as follows:

an elongated pump housing 51 with a central differentail diameter bore 52 passing therethrough for slidably receiving appropriate piston therein having an integral check valve seat 58 substantially midway of the housing, including at least two side ports:

an elongated piston assembly 69 with body of different diameters corresponding to the diameters of the differential diameter bore 52 for a sliding fit therein with a first piston end 70 of reduced cross section elongated comprising a pump actuating means at the first housing end, and with a second piston assembly end 60 terminating externally with a palm button 63 while inwardly continuing with a large piston portion 61 which terminates with a taper 62 adjacent seal 64 and a necked down piston section 65 of length equivalent to the pump stroke, with seal 66 inside the check valve seat 58 comprising integral check valve 67 of pumping means at the second housing end, including an intermediate diameter piston portion 86 starting at shoulder 87 adjacent seal 66;

an an electrically energized solenoid operator 55 disposed at the first housing end so as to exert pull force large enough to pull the piston end 70 against solenoid iron 54 shown with shading ring 56 facing a solenoid cavity 57 and thereby change the position of the piston assembly 69 from that shown in FIG. 2 to cause piston reciprocation with pumping when a solenoid coil 59 becomes electrically cycled making or breaking electric contact of the coil to continue pulling or releasing the piston assembly 69 which returns automatically to the original position by the force of a compression spring 71 lodged between a piston shoulder 72 at the end of the first piston end 70 of reduced cross section and the counterbore shoulder 73 of the solenoid operator 55.

It should be noted that in case of emergency or for priming purposes, the pump of FIG. 2 can also be actuated manually, by the palm button 63 in lieu of solenoid operator, through a simple depression of piston assembly 69 against the spring 71 by hand with a force sufficient also to displace fluid accumulated in the pump chamber, a factor of great importance in many applications, and in particular in cases where electricity is scarce, although the use of such palm button may be considered optional. But so is the solenoid operator 55 which can be considered optional for applications designated to be manual.

Turning back to the description of the design of FIG. 2 and in particular to the housing bore 52, it is seen that housing 51 includes a first housing end 82 provided with an elongated bore portion 53 having at its mouth threads 53-*a* adaptable to receive a threaded boss 74 of the solenoid operator 55 and passing inwardly partway toward the second housing end, and a second housing end 75 provided with a large opening 76 having an inwardly passing straight bore section 77 toward the first housing end including a conical seat 78 starting with cone base 79 at the end of straight bore section 77 and tapering down toward the integral check valve seat 58 which in fact represents the smallest diameter of bore 52 however of relatively short length as it again increases in the diameter immediately at a bore shoulder 80 to an intermediate diameter bore portion 81 which is larger than the check valve seat 58, continuing toward the first housing end until it meets with bore portion 53, including an internal groove 83 with a seal 84 at a shoulder 85 joining bore portions 53 with 81 of different diameters.

With piston assembly 69 inside the housing bore 52, the first piston position illustrated in FIG. 2 shows clearly that the shoulder 87 of piston assembly 69 is resting against the bore shoulder 80 as a result of the force of the compression spring 71 thereby cutting off the fluid communication not only between a side port 68 provided with an inlet check valve 17 with a floater 18 situated therein to feed pump chamber 88 and a side port 89 serving as a pump discharge means but also between the side port 89 and the solenoid cavity 57 both protected by seals 66 and 84.

Consequently, the pump chamber 88 of FIG. 2 created between the conical bore seat 78 and the piston taper 62 being open to draw fluid to be pumped via check valve 17 is, at the pump exit port of integral check valve 67, protected by a seal 66 inside seat 58. As soon as the solenoid operator 55 becomes electrically energized, the position of piston assembly 69 changes tending to eliminate the pump chamber 88 by having mating piston taper 62 of an angle identical to the angle of the conical bore seat 78 bottom each other displacing all fluid therefrom for a discharge through the side port 89 until the solenoid operator becomes deenergized at which time spring 71 will return piston assembly 69 back into original position shown in FIG. 2.

As can be seen from the description above the solenoid operated pump is indeed very simple and performs a pumping function in accordance with the objectives of this invention.

This invention is not restricted to the slavish imitation of each and every one of the details and features described above, which have been set forth merely by way of example, with the intent of most fully setting forth the teaching of the invention. Obviously, devices may be provided which change, eliminate, or add certain specific structural details without departing from the invention.

What is claimed is:

1. A metering pump comprising:

an elongated housing with a bore passing therethrough having bore portions of different diameters along said bore length for receiving slidably a piston assembly therein of elongated piston portions of the diameters corresponding to the diameters of said bore, and a first housing end provided with a large bore end adaptable to be closed by an electrical solenoid operator which is disposed in an operable relationship with said piston assembly, said piston assembly dividing said bore into a first pump actuating end provided with said solenoid operator and a second pumping end provided with different diameter pump chambers of which a first pump chamber adjacent a second housing end is larger while a second pump chamber spaced substantially between said first chamber and said solenoid operator is smaller, said first chamber including a first fluid supply port entering said housing bore via side wall perpendicularly to feed fluid into said first pump chamber receiving fluid volume larger than that receivable in said second chamber, an integral first check valve means between said first and second pump chambers maintained normally closed, including a second fluid exhaust port adjacent said first check valve means incorporated therein in said second pump chamber, in combination with said solenoid operator, means for actuating said piston assembly from a first position allowing said first pump chamber to be filled by fluid entering via said first fluid supply port and a second position discharging a metered fluid quantity per stroke via said second exhaust port of said second pump chamber proportional to the difference of volumes said first larger chamber and said second smaller chamber provide when said piston assembly is moved therein, facilitating a cooperative effect in pumping wherein said first and said second chambers form but one combined variable volume chamber defining together with said piston portions of said piston assembly a pump delivery that provides volumetric displacement equivalent to the difference between said pump chambers after fluid from said first pump chamber is transferred to said second pump chamber when said large piston portion inside said first large pump chamber bottoms while said first fluid supply port is disconnected.

2. A metering pump as in claim 1 wherein said pump housing includes first and second ends interconnected by said differential diameter bore, said bore having a first diameter portion adjacent said first end extending inwardly therefrom toward said second end, a second diameter portion adjacent said second end extending inwardly therefrom toward said first end, a third diameter portion of slightly smaller diameter than said first diameter portion interconnected therewith by a first shoulder and having an internal groove adjacent said shoulder at one end of said third diameter bore portion while at the other opposite end extending inwardly therefrom toward said second housing end terminating through a second shoulder with a reduced diameter seat of said integral check valve, and a tapered bore portion with conical seat including a taper angle interconnecting at one end with said check valve reduced diameter seat and at the other end with said second diameter bore portion, said piston assembly further including a first and second ends interconnecting said piston portions, a first elongated piston portion of reduced diameter cross section comprising said first end extending inwardly therefrom toward said second end situated inside said first diameter bore portion of said housing bore, a second elongated piston portion of larger diameter cross section terminating with a palm button comprising said second piston end extending inwardly therefrom toward said first end closely received inside said second diameter portion of said housing bore while said palm botton externally protrudes, a third elongated piston portion, of a diameter slightly larger than said first piston portion of cross section reduced, interconnecting said first end through a first shoulder at one end of said third elongated piston portion, closely received in said third diameter bore portion, while at the opposite end extending inwardly therefrom toward said second piston end, to terminate through a second shoulder with a necked down piston portion of a diameter considerably less than the diameter of said check valve reduced diameter seat, and a tapered piston portion of an angle identical to the angle of said conical bore seat interconnecting said second elongated piston portion adjacent a peripheral seal thereof at one end comprising a base of said taper while the other taper end comprising a diameter of said necked down piston portion, a seal inside a peripheral groove of said necked down portion adjacent said second shoulder closely received inside said check valve reduced diameter seat when said piston assembly is in said first position, said tapered piston portion and said conical bore seat comprising a set of pumping members set a distance apart forming said first pump chamber therebetween, including a spring biasing means for exerting a biasing force on said piston assembly for an automatic return to said first original position, after the actuation thereof comprising a pumping of fluid in metered amounts for a precise delivery per each pump stroke from said first fluid supply port through said pump chambers to exhaust via said second fluid discharge port.

3. A metering pump as in claim 2 wherein, said operator adaptable to selectively move said piston assembly from said first position with said first pump chamber drawing fresh fluid supply thereto to said second position discharging fluid in metered amounts from said second pump chamber when said pumping members meet during the pump operation accompanied by cycling of said operator, said spring biasing means including a compression spring lodged between said operator and said first shoulder of said third piston portion to urge said piston assembly to assume said first position wherein said second shoulder with said necked down portion of said piston assembly abuts said second shoulder of said third diameter bore portion, whereas when said solenoid operator is energized, said first piston end of elongated piston portion becomes magnetically pulled into an operator cavity resulting in said position change of said piston assembly from said first to said second position accompanied by fluid discharge from said pump chambers when said pumping members meet, de-energization of said operator electrically causes said piston assembly to be forced by said spring to and maintained in said first position until cycle repeats.

4. A metering pump as in claim 2 wherein said actuating means are selectively performed by said palm button of said piston assembly through a manual depresion thereof against said spring biasing means, removing hand force from said palm button allows said spring biasing means to return said piston assembly to said first position while depressing said palm button changes said position forcing said pump to discharge fluid from said pump chambers until said pumping members meet in said second position.

5. A metering pump for dispensing exact fluid quantities per stroke when actuated by a solenoid operator directly comprising:

an elongated pump housing having a first and a second ends interconnected by a central bore of different diameters passing therethrough and adaptable for receiving an elongated axially movable reciprocating piston assembly capable of dispensing metered amounts of fluid therefrom, including a set of pump chambers of a large and small diameters separated by an integral check valve means therebetween situated substantially midway between said first and said second housing ends inside said bore with fluid supply and exhaust ports incorporated therein, and a first large diameter pump chamber formed by a first larger diameter piston with a seal adjacent said second end of said centeral bore while a second small diameter pump chamber spaced a distance away from said first large diameter pump chamber toward said first end of said central bore separated by said integral check valve means is provided with a smaller diameter piston section of said piston assembly, said bore and said piston assembly including mating pump surfaces therein, an electrical solenoid operator secured inside said first bore end in a direct operable relationship with said piston assembly capable of shifting said piston assembly from a first position of fluid delivery into said first large diameter pump chamber via said fluid supply port incorporated therein when said solenoid operator is not electrically energized to a second position of fluid discharge from said second small diameter pump chamber via said fluid exhaust port incorporated therein when said solenoid operator is electrically energized exerting a magnetic pull force over a first end of said piston assembly inside a solenoid bore to result in said shifting thereof, and when said piston assembly is in said first position, a void is created between said mating pump surfaces of said piston assembly and said housing bore in said first pump chamber between said larger diameter piston and an end of said large diameter pump chamber adjacent said second small diameter pump chamber communicating therewith via smallest diameter short section of said central bore for fluid flow from said first to said second pump chambers when said piston assembly is shifted from said first to said second positions, said first pump chamber adaptable of receiving exact quantities of fluid per stroke when said piston assembly is in said first position for delivery thereof to said second pump chamber when said piston assembly is shifted to said second position, while when said piston assembly is in said second position, said mating pump surfaces of said first pump chamber meet eliminating said void, with a simultaneous fluid discharge therefrom in a volumetric displacement equivalent to the difference between said pump chambers providing means for pumping metered quantities of fluid per stroke, including means for reciprocation of said piston assembly with multiplication of strokes when said solenoid is alternatingly energized and de-energized electrically with associated axial movement of said piston assembly inside said housing bore for continuous suction and discharge of fluid pumped, said axial movement of said piston assembly including a biasing force means incorporated therein.

6. A metering pump as in claim 5 wherein said mating pumping members are plain square shoulders between a bore portion and a piston portion comprising said first pump chamber.

7. A metering pump as in claim 5 wherein said biasing force means includes a compression spring lodged against said first end of said piston assembly inside said solenoid bore to maintain said piston assembly in said first pump open position until said piston assembly is moved to assume said second pump discharge position by said solenoid operator when energized, de-energization of said solenoid operator electrically allows an automatic return of said piston assembly to said first pump open position by said spring biasing force means.

8. A metering pump as in claim 5 including a detacheable check valve means in said fluid supply port for improved control of fluid metered inside said first pump chamber provided with said integral check valve means.

9. A metering pump as in claim 5 wherein said biasing force means includes a manual button in a second end of said piston assembly protruding from said second bore end of said housing, said manual button providing means for shifting said piston assembly from said first to said second positions without the use of said solenoid operator.

10. A metering pump as in claim 9 wherein said biasing force means includes a compression spring lodged against said first end of said piston assembly inside said solenoid bore to maintain said piston assembly in said first position until said piston assembly is moved to said second position by application of an opposing a hand force over said manual button thereof in said second end of said piston assembly protruding from said second bore end of said housing to shift said piston assembly against said spring biasing force means constituting pumping, removal of said hand force from said manual button allows an automatic return of said piston assembly to said first position by said spring biasing force means exerting constantly a force in the direction opposite to the direction said hand force provides thereupon.

* * * * *